United States Patent [19]

David

[11] Patent Number: 4,574,712

[45] Date of Patent: Mar. 11, 1986

[54] WOOD CHIP BURNING STOKER TYPE FURNACE

[76] Inventor: Emil J. David, P.O. Box 942, Station "F", Thunder Bay, Ontario, Canada, P7C 4X8

[21] Appl. No.: 644,250

[22] Filed: Aug. 27, 1984

[51] Int. Cl.[4] ..... F23K 3/10

[52] U.S. Cl. ..... 110/288; 110/255; 110/101 R; 110/258; 110/292

[58] Field of Search ..... 110/101 R, 104 B, 102, 110/255, 105.6, 196, 197, 257, 258, 263, 265, 292, 293, 288

[56] References Cited

U.S. PATENT DOCUMENTS

| | | | |
|---|---|---|---|
| 1,883,595 | 10/1932 | Cross | 110/288 |
| 2,063,347 | 12/1936 | Seaman | 110/288 |
| 2,122,711 | 7/1938 | Birkenbenel | 110/288 |
| 2,195,278 | 3/1940 | Leas | 110/101 R |
| 2,228,947 | 1/1941 | Casey | 110/288 |
| 2,240,972 | 5/1941 | Winkler et al. | 110/288 |
| 2,333,316 | 11/1943 | Klossner | 110/288 |
| 2,359,638 | 10/1944 | Greger | 110/288 |
| 3,232,254 | 2/1966 | Rivers | 110/101 R |
| 4,391,205 | 7/1983 | Morey | 110/255 |
| 4,454,828 | 6/1984 | Zempel | 110/101 R |

*Primary Examiner*—Henry C. Yuen
*Attorney, Agent, or Firm*—Stanley E. Johnson

[57] ABSTRACT

A fuel feed system for feeding particulate combustible material to a stove, a heater, furnace or the like, referred to herein as heating equipment, and the same in combination with such feed system wherein the combustible material is wood, preferably wood chips. A container is provided for holding a supply of the wood chips to be burned and a cover removably mounted on the container which, during use, is sealed on the container so as to provide a sealingly closed container. The conveyor system for moving the wood chips from the container to a burner in the heating equipment includes a first conveyor and a second conveyor for moving the wood chips along respective different flow paths and a drop box between such first and second conveyors that provides a contiguous flow path along the conveyor system. A normally closed one way flow valve is located in the drop box to prevent reverse flow through the drop box from said second to said first conveyor. The cover is slidably mounted on said container and arranged such that the entire cover is raised vertically off the container when one edge thereof is lifted and thereafter the cover can be slid laterally on a slide mechanism.

4 Claims, 9 Drawing Figures

WOOD CHIP BURNING STOKER TYPE FURNACE

This invention relates primarily to domestic heaters and more particularly to a feed system for feeding particulate combustible material such as wood chips to the burner of the heater, to a burner for the heater and a heating system including the heater and feed system.

Heaters with some means of feeding combustible particulate material thereto are well known and often referred to as stoker type heaters, but have utilized mainly pulverized coal or some similar combustible particulate material. Such heaters were later replaced by oil or gas fired heaters when gas and oil was in plentiful supply. Because of increasing costs of gas and oil, attention again is being directed to wood burning heaters, the majority of which burn solid or split logs of predetermined length. Heaters of this type must be hand fed and even with sophisticated automatic controls there normally is an insufficient supply of fuel to last throughout an evening or night's heating.

An object of the present invention is to provide a wood burning heater where the wood, instead of being in solid form, is fed as discrete particles, preferably chips, to the burner.

A stoker type heater basically consists of a reservoir for containing the fuel supply, feed means for conveying the combustible fuel supply from the container to the burner in the combustion chamber of the heater and an air supply means for use in combustion of the combustible fuel.

In using chips as a fuel supply, there are a number of problems which must be overcome and not encountered when using, for example, pulverized coal. One problem concerns feeding the chips to the burner from the supply reservoir. Chips have a tendency to form an arch above the conveyor, that moves the chips from the reservoir to the burner, and when this occurs there will be no chips on the conveyor for conveyance of the same to the burner.

An object of the present invention is to provide means for agitating the chips in the chip reservoir preventing formation of such arch and thereby ensure a continuous supply of chips to the heater for burning.

Another problem associated with burning wood chips is that they are readily combustible and this can result in what might be considered or referred to as back burning. In such situation, combustion of the chips moves backwards from the burner in the heater through the auger or other conveyor means to the supply of chips, particularly when the auger conveying the chips is only partially filled with chips.

Another object of the present invention is to provide a chip supply conveying means whereby such back burning is prevented from reaching the supply of chips.

Another object of the present invention is to provide a chip reservoir whereby even if burning should reach the reservoir, there is no adverse affect. This is accomplished by having a sealtight chamber containing the supply of chips, the only outlet of which is to the burner by way of the chip conveying means.

Applicant, through testing, has found it desirable to have a particular type of burner for wood chips and which is different from burners utilized for pulverized coal. The density of wood chips to be burned is substantially less than that of pulverized coal and to ensure proper burning without any back-up of smoke through the chip supply system, part of the combustion air is directed from the infeed side of the burner toward the burning area.

In keeping with the foregoing, there is provided in accordance with one aspect of the present invention:

apparatus for feeding particulate combustible fuel material to a heater comprising a container for holding a supply of the particulate material:

a cover removably mounted on the container and, during use, being sealed so as to provide a sealingly closed container; and a conveyor system for moving the particulate material from the container to a burner in the heater, said conveyor means comprising a first conveyor and a second conveyor for moving the particulate material along respective different flow paths, a drop box between said first and second conveyor providing a contiguous flow path along the conveyor system and a normally closed one way flow valve means in said drop box preventing reverse flow through the drop box from said second to said first conveyor.

In accordance with another aspect of the present invention there is provided:

a burner for use in a heater to burn particulate combustible material such as wood chips, sawdust or combinations thereof comprising an open top container for holding the particulate material during burning thereof and having at least some of the walls thereof perforated for flow of air through the perforations into the container;

conveyor inlet means for propelling particulate material into the container through a side wall thereof, such side wall having perforations therein for use in directing combustion air into the container in the direction of movement of the fuel supply into the container:

wall means attached to and spaced from the container, said wall means and container providing effectively a double walled container; and conduit means for providing an air flow path into the chamber of the double walled container.

The invention is illustrated by way of example with reference to the accompanying drawings wherein.

Figure 1:
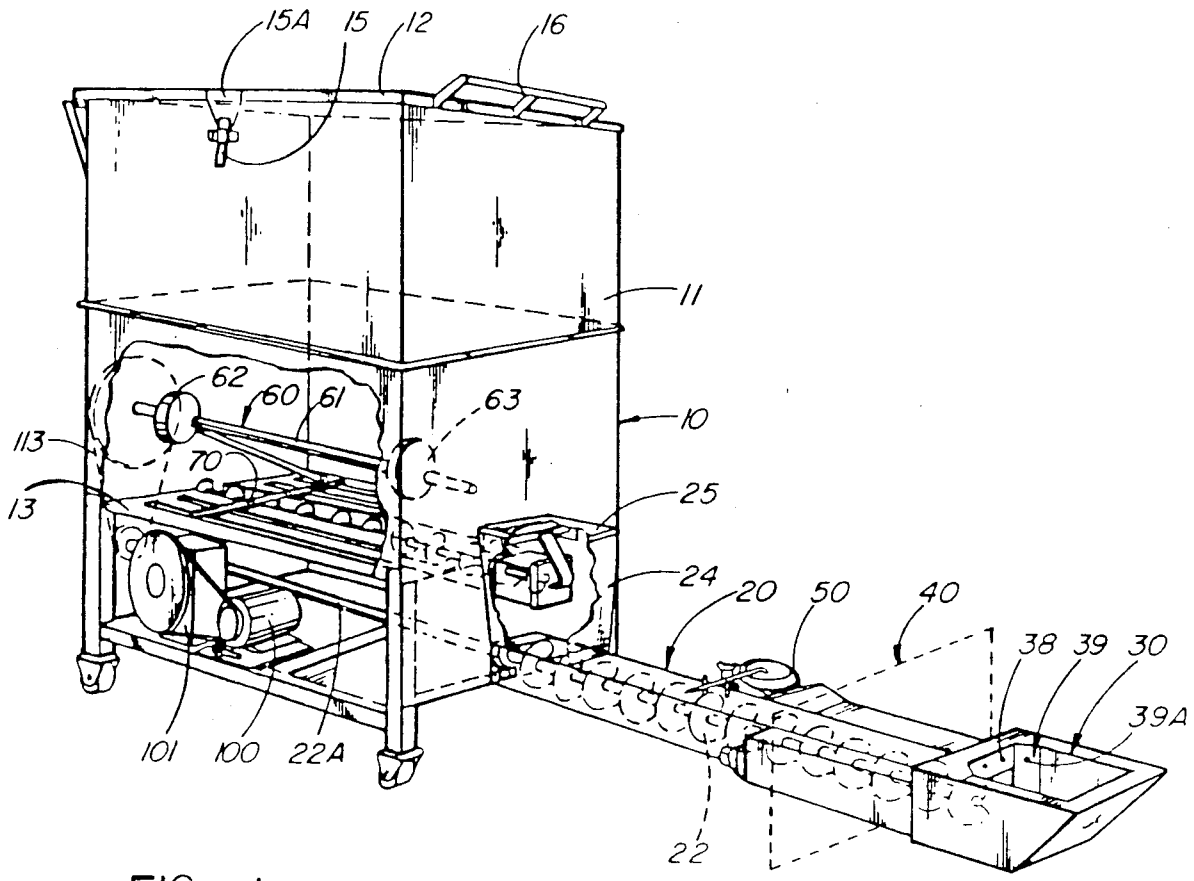
FIG. 1 is an oblique view of a container for holding particulate combustible material and conveyor means for conveying the particulate material from the container to a burner in a heater.
Figure 2:
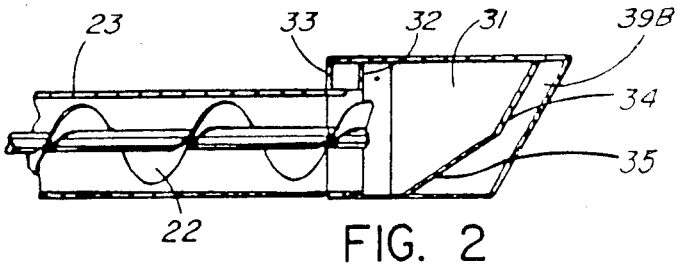
FIG. 2 is a partial cross-sectional view of a burner provided in accordance with the present invention.
Figure 3:
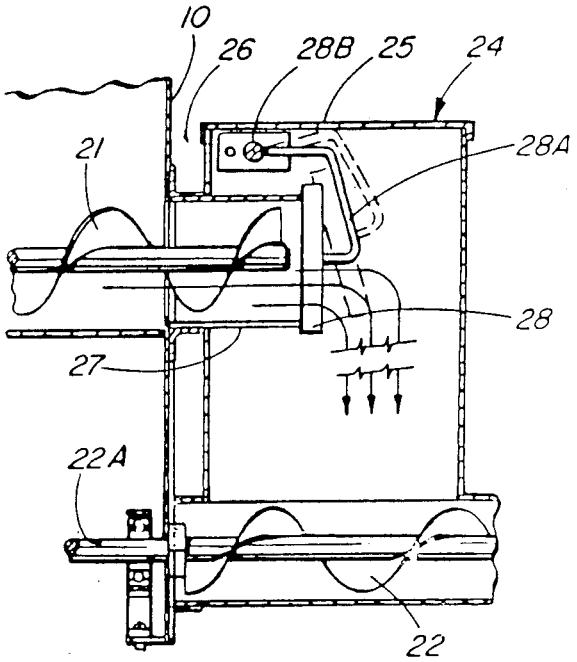
FIG. 3 is a partial vertical sectional view illustrating a drop box in the conveyor system with back flow preventing means.

Referring now to the drawings, there is illustrated in FIG. 1 a container 10 for holding a supply of combustible particulate material and which is fed by way of a conveyor system 20 to a burner 30 located within a heater 40, a portion of which is only illustrated by way of the broken line representing one wall thereo.

The word heater herein is intended as describing any enclosure with a firebox therein wherein a combustible material is burned in a burner for the purpose of providing heat and includes drum heaters, stoves, furnaces and the like primarily intended or used for domestic heating purposes.

The container 10 is preferably made of metal and has vertical side walls 11, a removable cover 12 and a bottom wall 13. In the bottom wall (see FIG. 7) there is a central depressed area 14 providing a channel in which there is located an auger type conveyor 21.

Figure 4A:
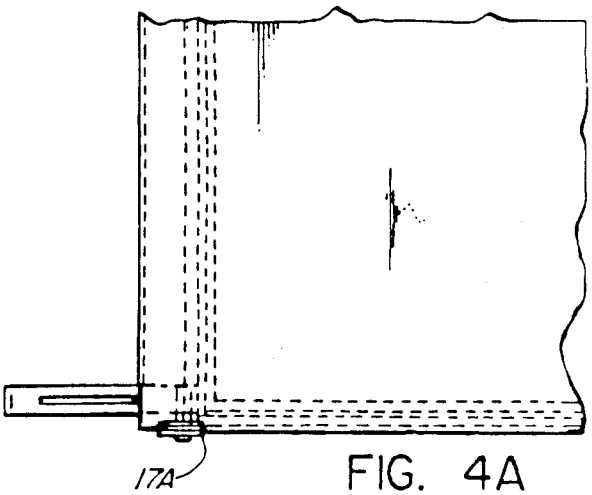
FIG. 4A is a partial top plan view of FIG. 4.
Figure 4:
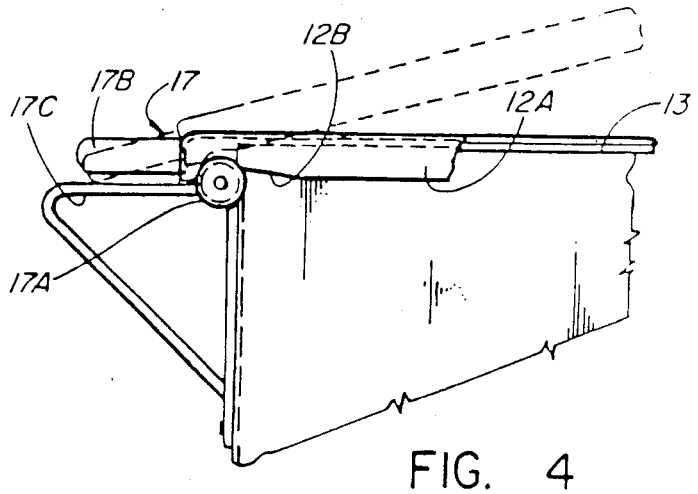
FIG. 4 is a partial elevational view of the container for the particulate material with a removable cover and means permitting removal of the same.
Figure 5:
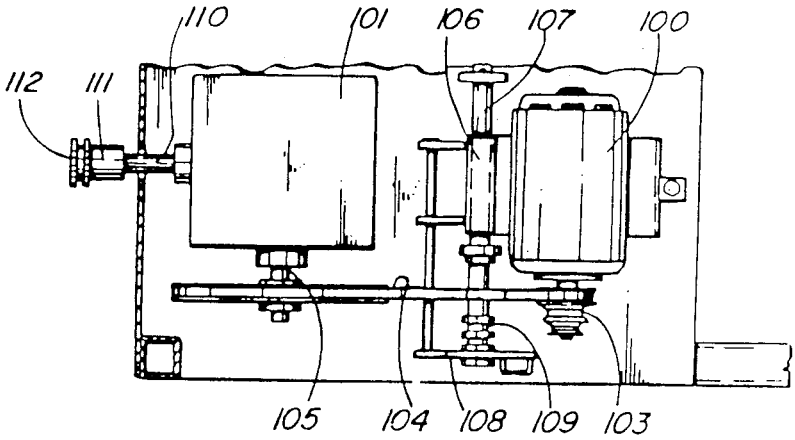
FIG. 5 is a partial top plan view of the conveyor drive system.
Figure 6:
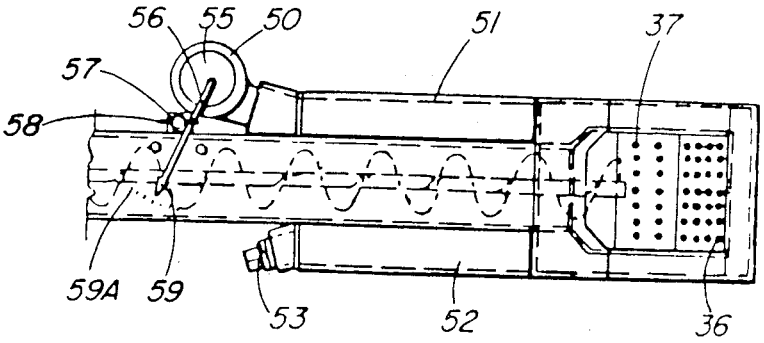
FIG. 6 is a top plan view of the burner and conveyor for moving thereinto the particulate material to be burned and the air supply system for the burner.

The removable cover 12 has downwardly projecting flanges 12A (FIG. 4) surrounding the peripheral walls 11 of the container. A gasket or other sealing means 13 is attached to the cover and/or upper edge of the side walls of the container so that the cover can sealingly close the container. The cover is locked in a closed position by over-center clamps 15, and in the embodiment illustrated there is one located respectively on opposite sides of the container and engageable with respective ones of a pair of lugs 15A secured to the cover and projecting downwardly therefrom. Any number of clamps may be used as may be required to hold the cover sealingly on the upper open end of the container. At the front end of the cover there is provided a handle 16 and at the opposite rearward end a cover lift and slide means so as to avoid damaging the seal 13 when the cover is slid rearwardly. The slide means consists of a pair of rollers 17A journalled on the container 10 and fitting into respective ones of a pair of notches 12B in the flanges 12A of the cover when the cover is in the closed position. The slide and cover lift mechanism further includes a pair of bars 17B secured to the cover and projecting rearwardly therefrom in overlying relation with respect to slide bars 17C attached to and projecting horizontally outwardly from the rear wall of the container 10. As illustrated by broken line in FIG. 4, when the cover 12 is lifted upwardly, by the handle 16, bars 17B engage the slide bars 17C raising the cover completely off the container. When the cover is moved to the left (as viewed in FIG. 4), bars 17B slide on the slide bars 17C until such time as they reach the end of the same whereafter the rollers 17A engage the downwardly projecting flanges 12A on the cover and continued movement to the left is by rolling movement of the cover on rollers 17A. While the cover could be pivoted to the container, ceilng heights in most installations, for example in the basement of a house, prohibit pivoting the cover sufficiently for feeding a supply of material to the container. Accordingly, the horizontal sliding movement is desired. The arrangement illustrated, permits having a completely sealed container while at the same time a removable cover arranged such that lifting thereof does not damage the seal when removing and placing the cover on the container.

The conveying system 20 consists of a first auger type conveyor 21 located in the channel 14 in the bottom wall of the container and a second auger type conveyor 22 located in a tube 23. The auger conveyors 21 and 22 are spaced vertically from one another and interconnected by a drop box 24 that provides a flow path for particulate material from the outlet of the first auger to the inlet of the second auger. The drop box 24 is an enclosure with a removable cover 25. The drop box 24 is mounted on, and preferably spaced from, the front wall of the container 10, the spacing between the container and the furnace wall being designated 26. This air space prevents heating the combustible material in the container 10, should the wood chips or other particulate material in the drop box catch on fire from back burning through auger 22. The first auger 21 discharges into the drop box through a short sleeve 27 that projects into the drop box. The end of the sleeve 27 is normally closed by the cover plate 28 attached to an arm 28A pivotally mounted on the walls of the drop box as by shaft 28B. The pivoting of the cover plate is arranged such or suitably weighted so that the end of the sleeve is covered when no material is flowing therethrough. The cover plate 28 is effectively a one-way flow control valve preventing back flow of smoke into the container 10. Should fire occur in the drop box, the cover plate 28 also prevents ignition of the chips in the auger short tube 27 and container 10.

The outlet end of tube 23 projects through a side wall of the burner 30 and discharges into the combustion area 31 of the burner. The burner 30 is an open topped double walled container having respective inner and outer walls 32 and 33. The bottom wall has a first sloping portion 34 and a second sloping portion 35, each sloping generally in the direction towards the discharge end of auger 22. The sloping bottom wall portion 34 has a plurality of apertures as indicated at 36 and similarly the sloping bottom wall portion 35 has a plurality of apertures as indicated at 37. The end wall through which the conveyor sleeve 23 projects is also apertured as indicated at 38 (see FIG. 1). Such end wall merges into the respective side walls by sloped corner walls 39 (i.e. 45° to the end and side walls), apertured as indicated at 39A. The double walled fire box effectively provides an enclosed air chamber 39B. Combustion air is fed to the air chamber 39B by a power driven fan 50 through a first conduit 51. A second air passageway conduit 52 is connected to the air chamber 39B. Apertures 38 in the end wall, wherein the auger terminates, have been found extremely beneficial in preventing back flow of smoke which occurred in an experimental model without such apertures. Air flow through apertures 38 and/or 39A drives volatile gases toward the burning area further inwardly of the burner, preventing occurrence of smoke from the dried chips adjacent the conveyor outlet end. Chips in that area obviously are dried somewhat from the heat of combustion in the burner.

The free end of conduit 52 is closed by a removable plug 53. Ash and other debris that may accumulate in air chamber 39B can be cleaned out by removing plug 53 and running fan 50 to blow air through conduit 51 through the air chamber 39B and exit through the outlet of conduit 52. Alternatively, plug 53 can be replaced by a second power driven fan thereby providing two air supplies to the air chamber 39B should such be required. The air inlet to fan 50 is partially covered by a movable end plate 55. The end plate is mounted on the end of a rod 56 pivotally mounted on a threaded bolt 57 and lockable at various positions by a wing nut 58. Rod 56 projects beyond the pivot providing a pointer that moves over a scale 59A to facilitate appropriately setting the end plate at various different positions for adjusting the volume of air flow to the burner.

Figure 7:
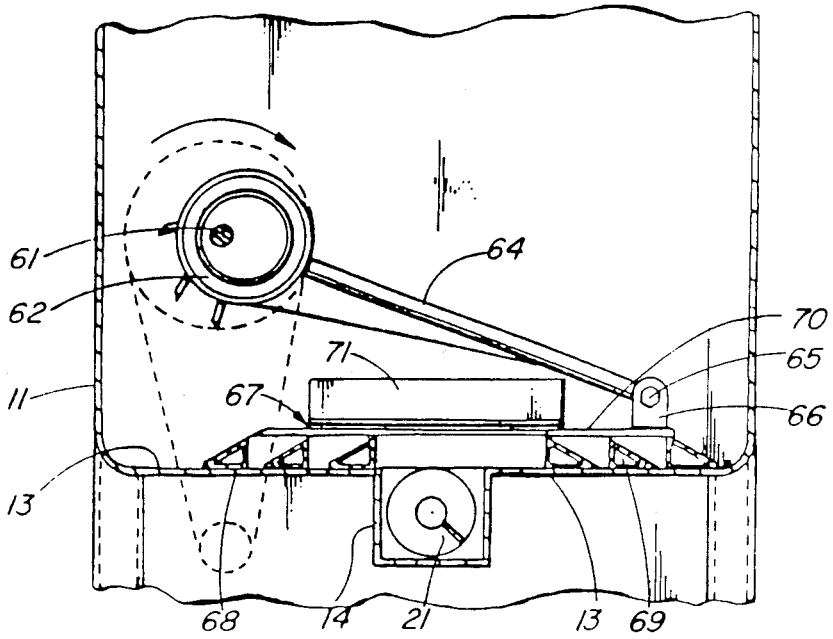
FIG. 7 is a partial vertical sectional view through the container with means in the bottom thereof for agitating the particulate material.

Referring to FIG. 1, there is illustrated a mechanism designated generally by the reference numeral 60 within the container 10 for the purpose of agitating the chips therein. As previously mentioned, chips have a tendency to arch above the auger and this is overcome by utilizing the agitator 60. The agitator 60 consists of a driven shaft 61 journalled at opposite ends for rotation on the respective front and rear walls of the container 10. Two bearings 62 and 63 are journalled on the shaft 61 eccentrically (see FIG. 7), the outer ring of the bearings being connected to respective ones of a pair of push rods 64. The opposite end of the respective push rods are connected by way of pins 65 to brackets 66 secured to an agitator or sweep mechanism 67. The mechanism 67 consists of a first series of parallel spaced apart bars 68 located on the floor of the container on one side of the channel 14 and a second series of parallel bars 69 located on the opposite side. The parallel bars 68 and 69 are connected by respective ones of a pair of cross bars 70 and to which brackets 66 are secured. The mechanism 67 is held down by respective ones of a pair of angles 71 secured to opposite side walls of the container. Rotation of the shaft 61 causes push rods 64 to reciprocate back and forth which in turn reciprocally moves mechanism 67 back and forth, moving bars 68 and 69 toward and away from the channel 14. To facilitate moving the chips, bars 68 as will be seen in FIG. 7, are right angular in cross-section as are also bars 69, the vertical walls facing the channel to facilitate moving the chips toward the auger.

Figure 8:
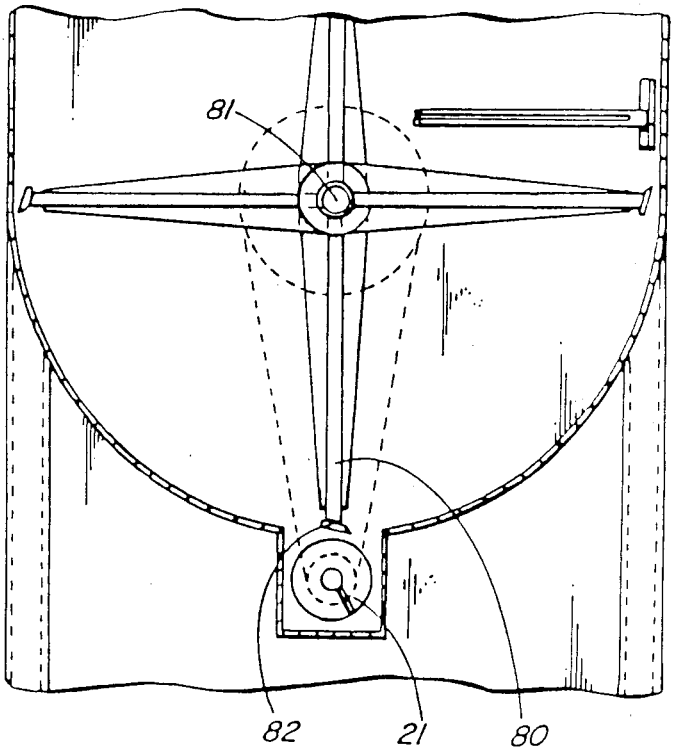
FIG. 8 is a view similar to FIG. 7 illustrating an alternative agitator for the particulate material in the container.

In FIG. 8 there is illustrated an alternative agitator comprising a plurality of arms 80 secured to and radiating outwardly from a shaft 81 journalled for rotation on opposite end walls of the container. Each arm has a flat blade mechanism 82 on the free outer end thereof to facilitate stirring or agitating the chips in the container. The plurality of arms 80, although not shown, are spaced apart from one another longitudinally along the length of the shaft 81. In this embodiment, the bottom wall of the container is rounded.

The conveyor system and chip agitator unit 60 are driven by an electric motor 100 by way of belts and chains through a speed reducing unit 101. The motor 100 has a stepped pulley unit 103 attached to the shaft thereof and, by way of the belt 104, drives an input shaft 105 of the speed reduction unit. The motor 100 has a sleeve 106 attached thereto and which is longitudinally slidably mounted on a shaft 107 and locked in position by any suitable means which, for example, may consist of an arm 108 attached to sleeve 106 and which fits into one of a plurality of grooves 109 in shaft 107, depending upon the location of the motor. In order to move the motor it is lifted so as to pivot about shaft 107 thereby disengaging the lever 108 from the groove 109. The motor can then be slid along the shaft to an appropriate selected position whereafter it is pivoted downwardly placing the lever 108 in one of the grooves 109.

The speed reduction unit 101 has an output shaft 110 on which there are mounted a pair of sprockets 111 and 112. Sprocket 111 meshes with a chain 113 which in turn meshes with a sprocket attached to shaft 61 of the chip agitator. Sprocket 112 meshes with another chain (not shown) which in turn meshes with a sprocket (not shown) attached to an extending portion of the shaft of auger 21, such shaft extending portion being designated 22A.

I claim:

1. A heater for use in burning particulate combustible material such as wood chips or the like comprising:

means for storing a supply of the particulate combustible material including a container having a cover removably mounted thereon and during use being sealed so as to provide a sealingly closed container:

means for feeding the particulate combustible material from the container to a burner in the heater comprising a first conveyor and a second conveyor for moving the particulate material along respective different flow paths from the container to a burner in the heater, a drop box between said first and second conveyor providing a contiguous flow path along the conveyor system for the particulate material and a normally closed one way flow valve means in said drop box preventing reverse flow through the drop box from said second to said first conveyor; and a burner in the heater comprising an open top container for holding the particulate material during burning thereof and having at least some of the walls thereof perforated for flow of air through the perforations, said second conveyor means discharging into the open top container of the burner through a side wall thereof, such side wall having perforations therein for use in directing combustion air into the container at least a portion of which flows in the direction of movement of the fuel supply into the container: wall means attached to and spaced from the container of the burner, such wall means and container providing effectively a double walled container with an air chamber therebetween: and first conduit means for providing an air flow path into the chamber of the double walled container.

2. A burner for use in a heater that uses particulate combustible material such as wood chips, sawdust or combinations thereof comprising an open top container for holding the particulate material during burning thereof and having at least some of the walls thereof perforated for flow of air through the perforations into the container;

conveyor inlet means for propelling particulate material into the container through a side wall thereof, such side wall having perforations therein for use in directing combustion air into the container at least a portion of which flows in the direction of movement of the fuel supply into the container;

wall means attached to and spaced from the container, said wall means and container providing effectively a double walled container with an air chamber therebetween;

first conduit means for providing an air flow path into the chamber of the double walled "container, and a second conduit means into said air chamber at a position spaced from said first conduit means, said second conduit has a removable plug for use in removing debris from the air chamber of the burner.

3. A burner as defined in claim 2 wherein a bottom wall of the container is perforated and slopes in a direction toward said conveyor inlet means.

4. A burner as defined in claim 2 including a power driven air supply means connected to each of said first and second conduits for forcing air into said air chamber.

* * * * *